US012790844B2

(12) United States Patent
Zhang et al.

(10) Patent No.: US 12,790,844 B2
(45) Date of Patent: Nov. 10, 2026

(54) SYSTEMS AND METHODS FOR ABOVE-GROUND POOLS

(71) Applicant: DONGGUAN POLYFILM PLASTIC PRODUCTS COMPANY LIMITED, Guang Dong Province (CN)

(72) Inventors: Yi Feng Zhang, Kiu Lik (CN); Jaime Ramos, Moorpark, CA (US)

(73) Assignee: Dongguan Polyfilm Plastic Products Company Limited, Dong Guan City (CN)

( * ) Notice: Subject to any disclaimer, the term of this patent is extended or adjusted under 35 U.S.C. 154(b) by 66 days.

(21) Appl. No.: 18/663,456

(22) Filed: May 14, 2024

(65) Prior Publication Data

US 2025/0314083 A1 Oct. 9, 2025

(30) Foreign Application Priority Data

Apr. 9, 2024 (CN) ..... 202410427126.0

(51) Int. Cl.
*E04H 4/00* (2006.01)

(52) U.S. Cl.
CPC ..... *E04H 4/0056* (2013.01)

(58) Field of Classification Search
CPC ..... E04H 4/0056; E04H 4/0018
USPC ..... 4/513
See application file for complete search history.

(56) References Cited

U.S. PATENT DOCUMENTS 5,083,327 A * 1/1992 Gillebaard ..... E04H 4/0056 220/4.16
5,592,702 A * 1/1997 Gillebaard, Jr. ..... E04H 4/0056 4/585
11,512,488 B2 11/2022 Huang et al.
2017/0089085 A1 3/2017 Liu
2019/0093376 A1 3/2019 Liu
2025/0354396 A1* 11/2025 Chu ..... E04H 4/0056

FOREIGN PATENT DOCUMENTS

CN 203097347 U 7/2013

OTHER PUBLICATIONS

Extended Search Report for EP 24180571.2 dated Nov. 21, 2024 (17 pages).
Examination Report No. 1 issued in AU 2024203876 dated Sep. 5, 2025, (11 pages).
How to Install an Above Ground Pool | INTEX Prism Metal Frame Pool Setup [Viewed on internet on Sep. 3, 2025] < URL: https://www.youtube.com/watch?v=Di3XZuGOBkg >, Published on Aug. 23, 2023.

* cited by examiner

*Primary Examiner* — Huyen D Le
(74) *Attorney, Agent, or Firm* — Finnegan, Henderson, Farabow, Garrett & Dunner LLP

(57) ABSTRACT

Embodiments of present disclosure provide an above-ground pool. The above-ground pool includes a pool liner and a band connected to the exterior of the pool liner. Furthermore, the above ground pool includes an above-ground pool frame with a plurality of above-ground pool horizontal frame members and a plurality of above-ground pool vertical frame members. The above-ground pool frame can be coupled with the pool liner. The above-ground pool further includes a first above-ground pool band-frame connector device, wherein the first above-ground pool band-frame connector device couples a first of the plurality of above-ground pool vertical frame members to the band.

8 Claims, 11 Drawing Sheets

SYSTEMS AND METHODS FOR ABOVE-GROUND POOLS

TECHNICAL FIELD

The present disclosure relates generally to above-ground pools, including apparatus, systems, and methods for installing above-ground pools.

BACKGROUND

A pool frame supports a pool liner that contains water in a determined volume and provides the support to hold water against the weight of the water and the liner. An above-ground pool takes advantage of avoiding the cost and effort involved with digging or otherwise excavating a space for a pool. Additionally, above-ground pools take advantage of being installed in locations where digging or excavating is impracticable or impossible. A pool liner ideally contains water in a determined volume against the weight of the held water and without leaking.

The frame and the liner may be installed as an intertwined unit. One or more frame members may be laced through one or more sleeves in the liner as the pool is being constructed. During disassembly for maintenance or to move the pool, the frame members may be disconnected as a section or individually to remove the frame members from the sleeves. In a different location, the frame members may be reconnected and laced through one or more sleeves in the liner.

FIG. 1 illustrates a conventional above-ground pool having a frame including a liner and a band that extends around the circumference of the pool to help support the weight of the pool when it is filled with water. As shown in FIG. 1, conventional above-ground pools include frame in which the vertical frame members are threaded between the liner and the band. Once the above-ground pool is filled with water, the vertical frame members press against the band, as shown in the conventional above-ground pool in FIG. 1, and gaps can form between the band the liner. An above-ground pool design is desired that does not include the gaps shown in the conventional above-ground pool in FIG. 1.

SUMMARY

Embodiments of present disclosure provide an above-ground pool. The above-ground pool includes a pool liner and a band coupled to the exterior of the pool liner. Furthermore, the above ground pool includes an above-ground pool frame with a plurality of above-ground pool horizontal frame members and a plurality of above-ground pool vertical frame members. The above-ground pool frame can be coupled with the pool liner. The above-ground pool further includes a first above-ground pool band-frame connector device, wherein the first above-ground pool band-frame connector device couples a first of the plurality of above-ground pool vertical frame members to the band.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
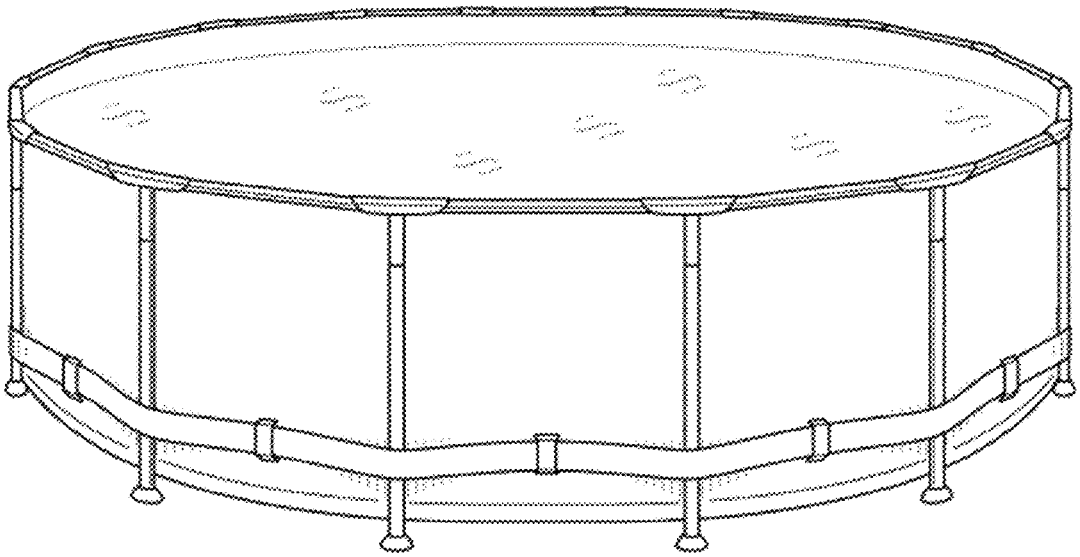
FIG. 1 illustrates a conventional above-ground pool.

The following disclosure provides many different exemplary embodiments, or examples, for implementing different features of the provided subject matter. Specific simplified examples of components and arrangements are described below to explain the present disclosure. These are, of course, merely examples and are not intended to be limiting. For example, the formation of a first feature over or on a second feature in the description that follows may include embodiments in which the first and second features are formed in direct contact and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

The terms used in this specification generally have their ordinary meanings in the art and in the specific context where each term is used. The use of examples in this specification, including examples of any terms discussed herein, is illustrative only, and in no way limits the scope and meaning of the disclosure or of any exemplified term. Likewise, the present disclosure is not limited to various embodiments given in this specification.

Although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In this document, the term "coupled" may also be used to indicate that two or more elements cooperate or interact with each other. Furthermore, the term "coupled" may be used to indicate that two or more elements are removably coupled, in that they can be uncoupled.

Figure 2:
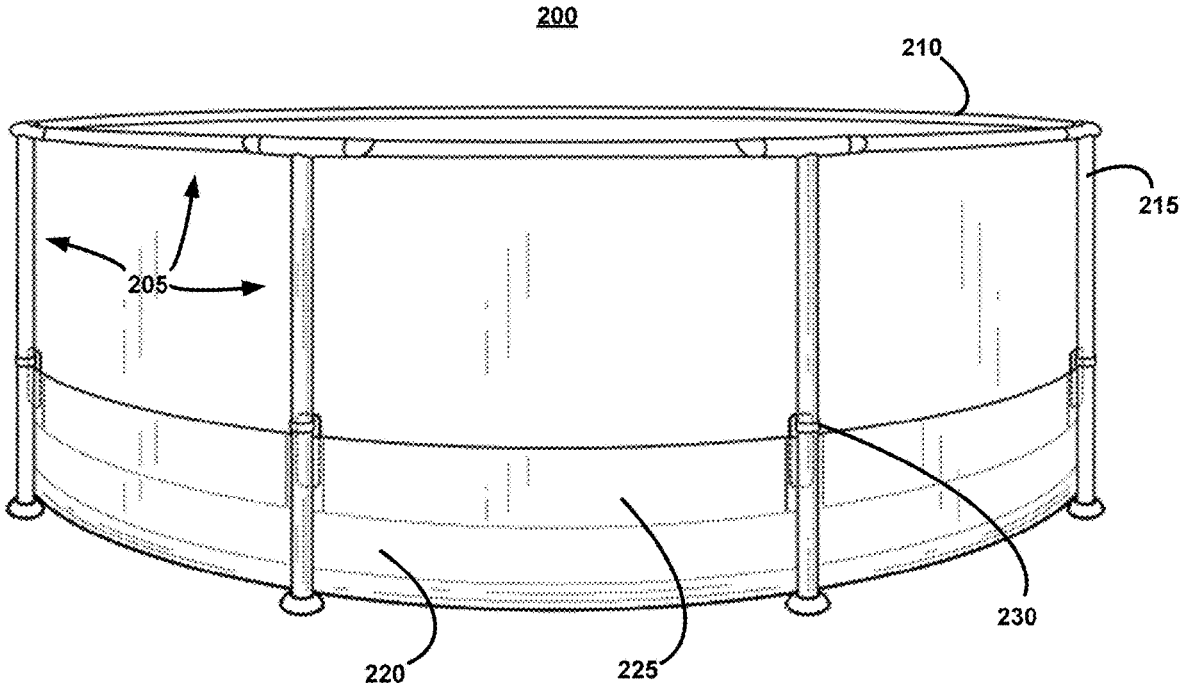
FIG. 2 is an illustration of an above-ground pool 200 according to some embodiments of the present disclosure.

FIG. 2 is an illustration of an above-ground pool 200 according to some embodiments of the present disclosure. In some embodiments, above-ground pool 200 may include an above-ground pool frame 205. In accordance with the present disclosure, some embodiments of the above-ground pool frame 205 may include one or more above-ground pool horizontal frame members 210 and one or more above-ground pool vertical frame members 215. Additionally, some embodiments of the above-ground pool 200 may include pool liner 220, which provides a water impermeable surface on the inside to retain the water of the above-ground pool 200 when filled. Furthermore, in some embodiments of the above-ground pool 200, the pool liner 220 is in partial communication with the above-ground pool frame 205 to provide the structure of the above-ground pool 200. Accordingly, the pool liner 220 may be configured to hold water within above-ground pool frame 205. In some embodiments of the above-ground pool 200, pool liner 220 may be configured to take up the volume within above-ground pool frame 205.

As shown in FIG. 2, in accordance with some embodiments of the present disclosure, the above-ground pool 200 can include a band 225. The band 225, in some embodiments, is separate from pool liner 220 and provides additional support for the pool liner 220 and the above-ground pool frame 205 to contain the bulging force created by water in the above-ground pool 200. Accordingly, in some embodiments, the band 225 may be a reinforcement of pool liner 220. As shown in FIG. 2, in some embodiments, the band 225 may configured around the entire outer circumference of the pool liner 220 proximate the lower portion of the above-ground pool 200. In some embodiments, the band 225 is made of durable and robust material capable of withstanding force applied by the weight of the water in above-ground pool 200. In some embodiments, the band 225 is made of similar material to the pool liner 220 of above-ground pool 200. In other embodiments, in accordance with some embodiments of the present disclosure, the band 225 is made of a different material than the pool liner 220 of above-ground pool 200. In accordance with some embodiments of the present disclosure, the band 225 and the pool liner 220 serve to contain water in a determined volume against the weight of the held water and without leaking.

As shown in FIG. 2, in accordance with some embodiments of the present disclosure, the above-ground pool 200 can be configured such that the vertical frame members 215 are connected to the band 225 and the pool liner 220 with an above-ground pool band-frame connector device 230. The above-ground pool band-frame connector device 230, in accordance with some embodiments of the present disclosure, can be configured to couple an above-ground pool vertical frame member 215 with the band 225 and the pool liner 220. As shown in FIG. 2, in accordance with some embodiments of the present disclosure, the above-ground pool 200 can be configured such that the band 225 is in close contact with the pool liner 220 with minimal gaps present when the above-ground pool 200 is filled with water. More specifically, in accordance with some embodiments of the present disclosure, when the above-ground pool 200 is filled with water, the band 225 is pulled taut against the pool liner 200 and minimal gaps are present between the pool liner 200 and band 225. Also, as shown in the embodiment in FIG. 2, the above-ground pool vertical frame members 215 of the pool frame 205 can be secured against the band 225 and pool liner 220 by the above-ground pool band-frame connector device 230. In accordance with some embodiments of the present disclosure, the above-ground pool vertical frame members 215 can be coupled to a coupling ring of the above-ground pool band-frame connector device 230 and a protrusion of the above-ground pool band-frame connector device 230 can be inserted into an aperture between the band 225 and the pool liner 220. As shown in FIG. 2, in accordance with some embodiments of the present disclosure, when the above-ground pool 200 is filled with water, the above-ground pool band-frame connector device 230 is pulled taut with the band 225 and pool liner 220 thereby securing the above-ground pool vertical frame member 215 against the side of the above-ground pool 200. As shown in embodiment of above-ground pool 200 in FIG. 2, the above-ground pool vertical frame members 215 are not threaded between the band 225 and the pool liner 220 but are configured external to both the pool liner 220 and the band 225. In accordance with some embodiments of the present disclosure, the above-ground pool band-frame connector device 230 can promote a secure, supported, and stable configuration of the above-ground pool 200 when the above-ground pool 200 is filled with water without having the above-ground pool vertical frame members 215 placed between the pool liner 220 and band 225. Furthermore, as shown in the embodiment of the above-ground pool 200 in FIG. 2, minimal gaps are presented between the band 225 and pool liner 215. Accordingly, in accordance with some embodiments of the present disclosure, there are no gaps that could by perceived by a user of the above-ground pool 200 as a step to be stepped on by the user. Furthermore, in accordance with some embodiments of the present disclosure, no surfaces are presented between the band 225 and pool liner 220 that might be perceived by a user of the above-ground pool 200 as a place to stand or step on the side of the above-ground pool 200.

Figure 3:
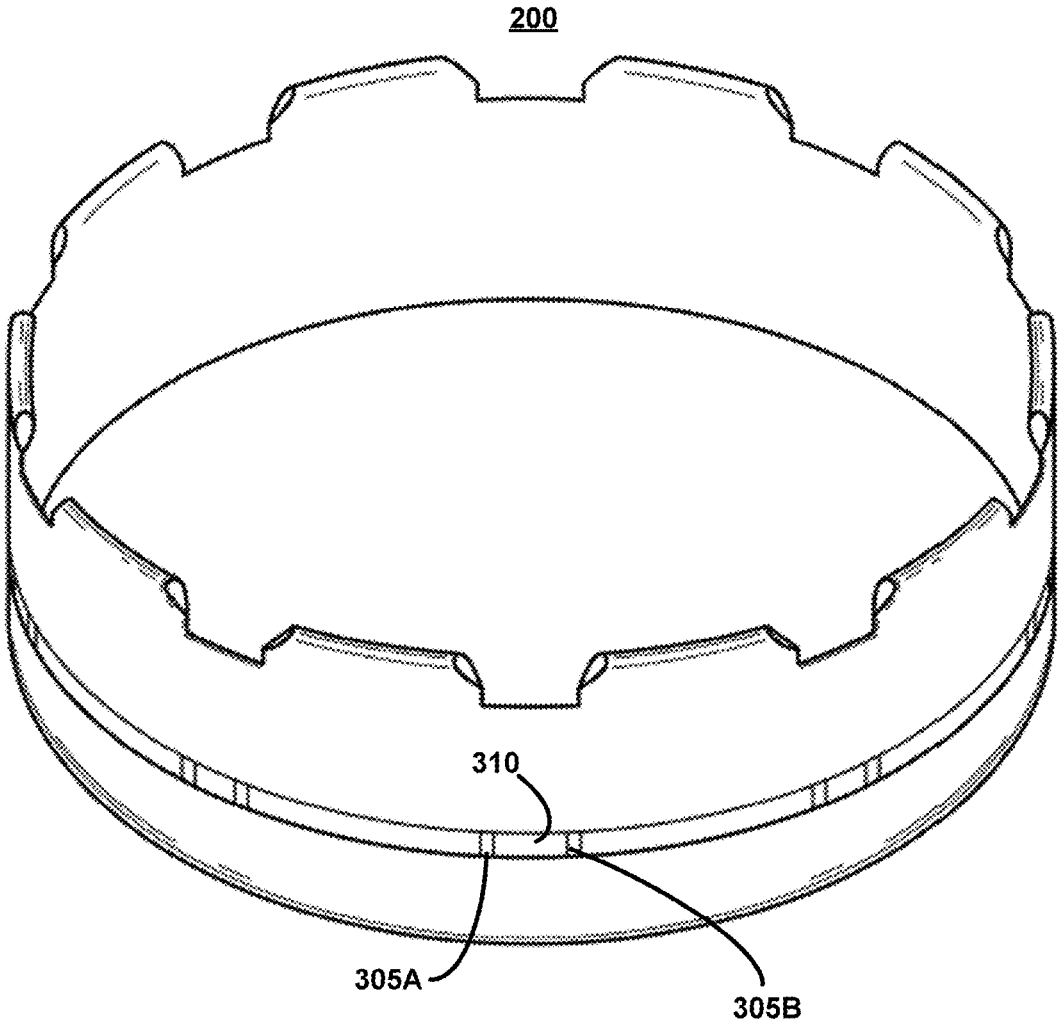
FIG. 3 is an illustration of a pool liner 220 of an above-ground pool 200 according to some embodiments of the present disclosure.

FIG. 3 is an illustration of a pool liner 220 of an above-ground pool 200 according to some embodiments of the present disclosure. In some embodiments, above-ground pool 200 may include a band 225 and pool liner 220. In accordance with some embodiments of the present disclosure, the band 225 can be securely attached to the pool liner 220. Those of skill in the art will appreciate that there are a variety of suitable techniques to attach the band 225 to the pool liner 220. For example, as shown in the embodiment in FIG. 3, the band 225 can be welded to the pool liner 220 to create a secure, durable, and reliable attachment. Those of skill in art will appreciate that there a number of techniques to weld the band 225 to the pool liner 220, including Radio Frequency ("RF") welding and dielectric welding. For example, with RF welding, a high frequency electric field can be applied to the band 225 and the pool liner 220 to heat and melt the base materials of the band 225 and the pool liner 220 while clamped together and the clamping force can be maintained until the weld solidifies. Those of skill in the art will appreciate that the technique for attaching the band 225 to the pool liner 220 can vary in accordance with the type of material used for the band 225 and/or the pool liner 220. In accordance with some embodiments of the present disclosure, as shown in the embodiment in FIG. 3, band 225 can be attached to the above-ground pool 200 at multiple points along the circumference of the band 225 around the exterior of the above-ground pool 200. For example, as shown in the embodiment in FIG. 3, the band 225 can be attached to the pool liner 220 at band attachment point 305A and band attachment point 305B. In accordance with some embodiments of the present disclosure, the proximity of the band attachment point 305A and band attachment point 305B can create a connector receiving aperture 310 between the band 225 and the pool liner 220 to receive the above-ground pool band-frame connector device 230. More specifically, connector receiving aperture 310 can provide an opening between the band 225 and the pool liner 220 to receive the insertion of above-ground pool band-frame connector device 230.

Figure 4A:
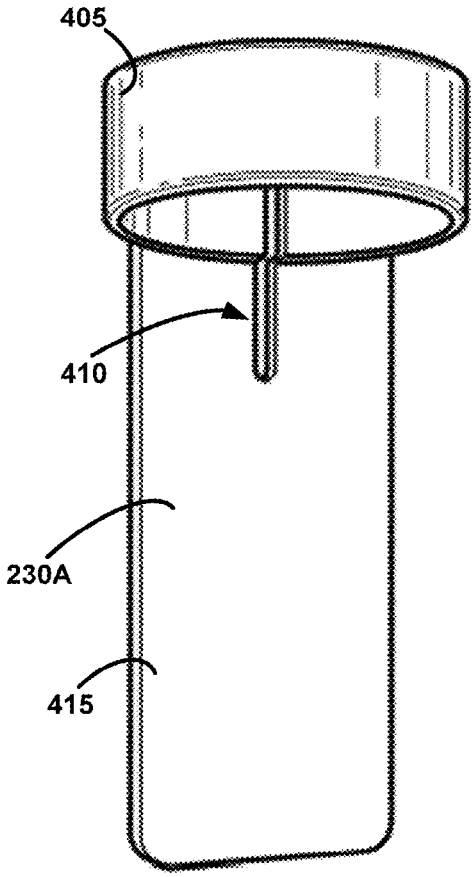
FIG. 4A is an illustration of above-ground pool band-frame connector device 230A according to some embodiments of the present disclosure.

FIG. 4A is an illustration of above-ground pool band-frame connector device 230A according to some embodiments of the present disclosure. As shown in the embodiment illustrated in FIG. 4A, the above-ground pool band-frame connector device 230A can include a coupling ring 405. In accordance with some embodiments of the present disclosure, the coupling ring 405 is configured to receive the above-ground pool vertical frame member 215 of the above-ground pool frame 205. As shown in the embodiment illustrated in FIG. 4A, the above-ground pool band-frame connector device 230A can include a flex slot 410, which extends for a distance less than the full length of the above-ground pool band-frame connector device 230A. In accordance with some embodiments of the present disclosure, the flex slot 410 of the above-ground pool band-frame connector device 230A is configured to allow expansion and contraction of the coupling ring 405; thereby, enabling the coupling ring 405 to expand to receive the above-ground pool vertical frame member 215 upon insertion of the vertical fame member 215 upon the construction of the above-ground pool frame 205 or to expand to allow removal of the above-ground pool vertical frame member 215 from the above-ground pool frame 205 upon deconstruction of the above-ground pool frame 205. Furthermore, in accordance with some embodiments of the present disclosure, the above-ground pool band-frame connector device 230A can provide a connector protrusion 415, which can be inserted into a connector receiving aperture 310 between the band 225 and the pool liner 220 of above-ground pool 200.

Figure 4B:
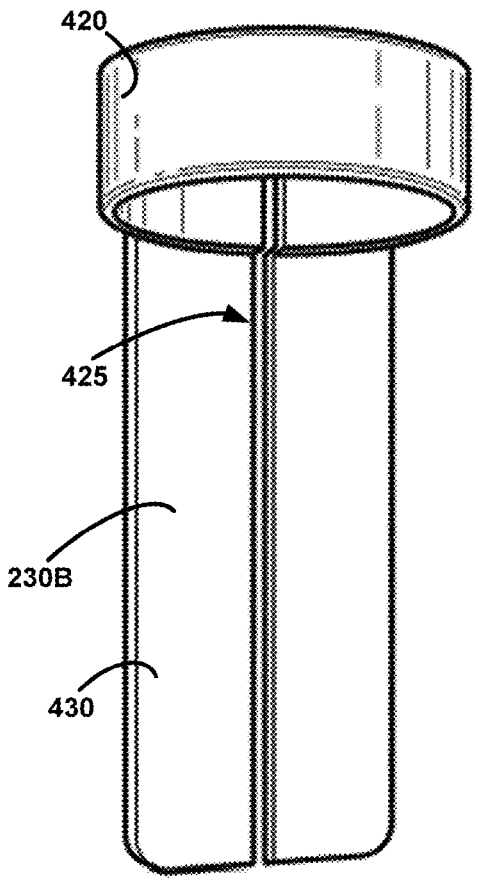
FIG. 4B is an illustration of above-ground pool band-frame connector device 230B according to some embodiments of the present disclosure.

FIG. 4B is an illustration of above-ground pool band-frame connector device 230B according to some embodiments of the present disclosure. As shown in the embodiment illustrated in FIG. 4B, the above-ground pool band-frame connector device 230B can include a coupling ring 420. In accordance with some embodiments of the present disclosure, the coupling ring 420 is configured to receive the above-ground pool vertical frame member 215 of the above-ground pool frame 205. As shown in the embodiment illustrated in FIG. 4B, the above-ground pool band-frame connector device 230B can include a flex slot 425. In accordance with some embodiments of the present disclosure, the flex slot 425 can extend the full length of the above-ground pool band-frame connector device 230B. In accordance with some embodiments of the present disclosure, the flex slot 425 of the above-ground pool band-frame connector device 230A is configured to allow expansion and contraction of the coupling ring 420; thereby, enabling the coupling ring 420 to expand to receive the above-ground pool vertical frame member 215 upon insertion of the member 215 upon the construction of the above-ground pool frame 205 or to expand to allow removal of the above-ground pool vertical frame member 215 from the above-ground pool frame 205 upon deconstruction of the above-ground pool frame 205. Furthermore, in accordance with some embodiments of the present disclosure, the above-ground pool band-frame connector device 230B can provide a connector protrusion 430, which can be inserted into a connector receiving aperture 310 between the band 225 and the pool liner 220 of above-ground pool 200.

Figure 5:
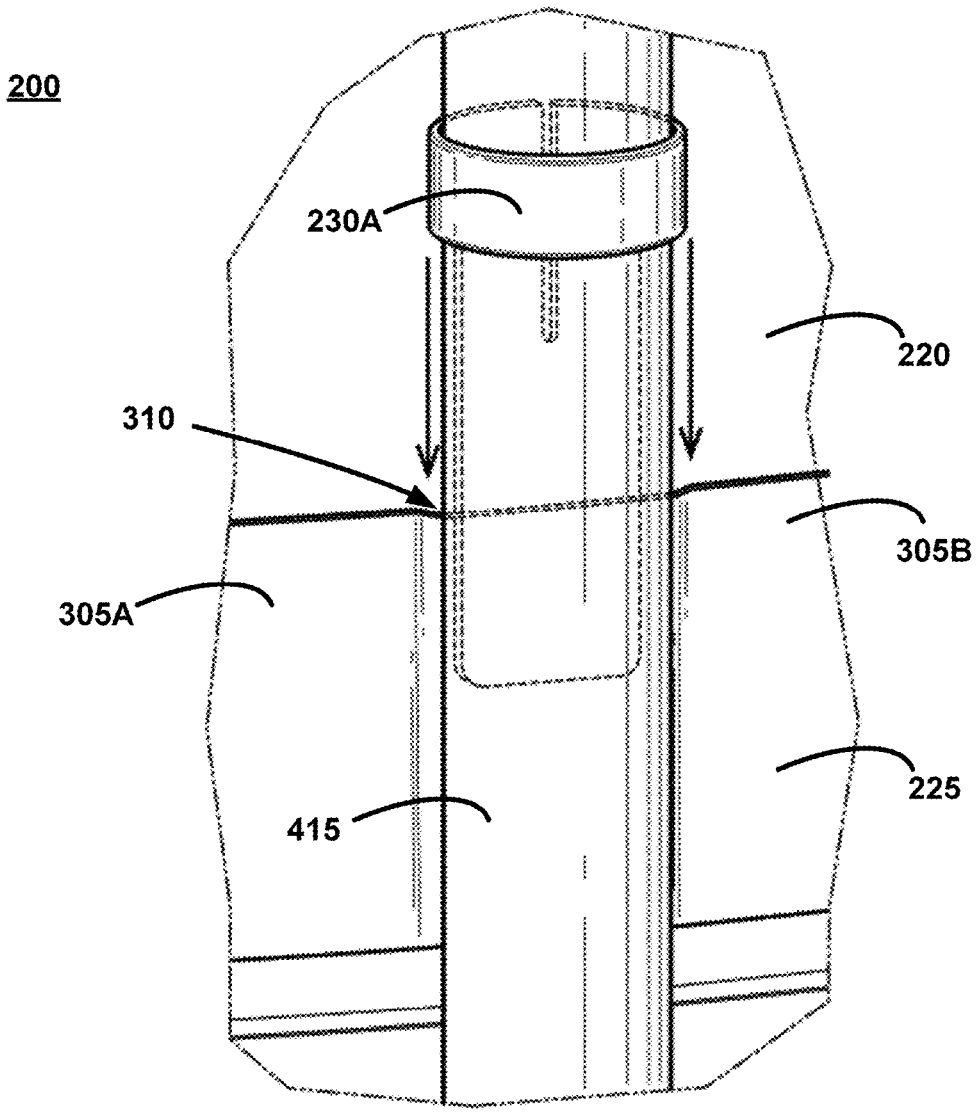
FIG. 5 is an illustration of portion of the side of an above-ground pool 200 according to some embodiments of the present disclosure.
Figure 6A:
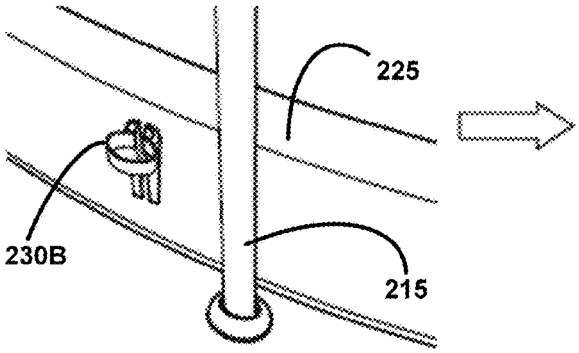
FIGS. 6A-6D provide a step-by-step illustration of coupling the above-ground pool band-frame connector device 230B with the above-ground pool 200 in accordance with some embodiments of the present invention.
Figure 6B:
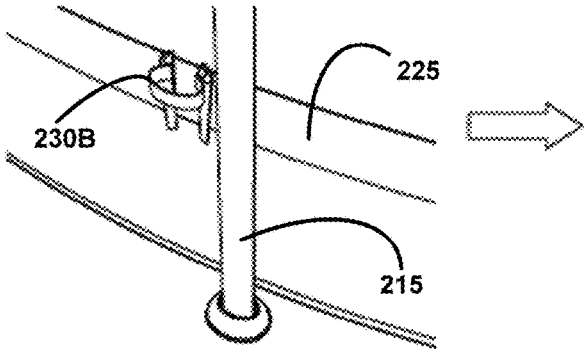
Figure 6C:
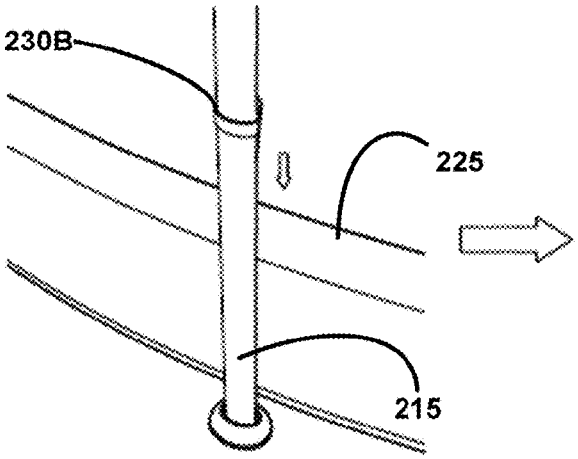
Figure 6D:
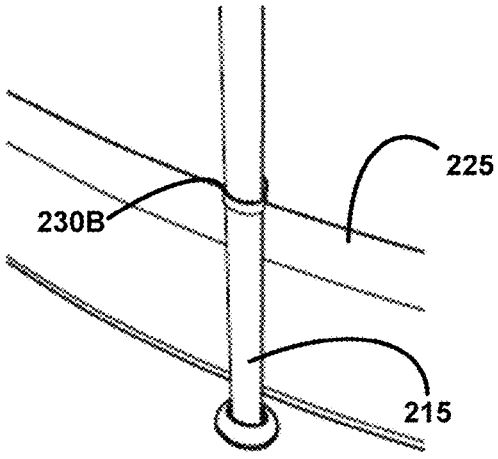

FIG. 5 is an illustration of a portion of the side of an above-ground pool 200 according to some embodiments of the present disclosure. FIG. 5 provides an illustration of the above-ground pool band-frame connector device 230A according to an embodiment of the present disclosure in which the above-ground pool vertical frame member 215 has been coupled with the coupling ring 405. As shown in the embodiment illustrated in FIG. 5, the connector protrusion 415 of the above-ground pool band-frame connector device 230A can be inserted into a connector receiving aperture 310 between the band 225 and the pool liner 220 of above-ground pool 200. In accordance with some embodiments of the present disclosure, insertion of the connector protrusion 415 of the above-ground pool band-frame connector device 230A into the connector receiving aperture 310 between the band 225 and the pool liner 220 of above-ground pool 200 provides a stable and secure connection between the above-ground pool vertical frame member 215 of the above-ground pool frame 205 and the pool liner 220. Accordingly, when forces act to separate, compress, tear, otherwise distort the structure and integrity of the above-ground pool 200, the connection enabled by the above-ground pool band-frame connector device 230A provided by some embodiments of the present disclosure can aid in securing and maintaining the structure and integrity of the above-ground pool 200. Those of skill in the art will appreciate in some embodiments, the above-ground pool 200 is heavy when filled with water, and the above-ground pool band-frame connector device 230 can aid in ensuring the structure and integrity of the above-ground pool 200 when fully installed and configured.

FIGS. 6A-6D provide a step-by-step illustration of coupling the above-ground pool band-frame connector device 230B with the above-ground pool 200 in accordance with some embodiments of the present invention. As shown in the embodiment illustrated in FIG. 6A, the above-ground pool vertical frame member 215 can be constructed proximate to the band 225 surrounding the pool liner 220 of the above-ground pool 200. As shown in the embodiment illustrated in FIG. 6B, the flex slot 425 of the above-ground pool band-frame connector device 230B can be flexed to open and expand the coupling ring 420 to receive the above-ground pool vertical frame member 215 of the above-ground pool frame 205. Accordingly, in accordance with some embodiments of the present disclosure, the above-ground pool band-frame connector device 230B can be removably coupled to the above-ground pool vertical frame member 215. As shown in the embodiment illustrated in FIG. 6C, the connector protrusion 415 of the above-ground pool band-frame connector device 230B can be inserted into a connector receiving aperture 310 between the band 225 and the pool liner 220 of above-ground pool 200 by sliding the connector protrusion 415 into the connector receiving aperture 310. As shown in the embodiment illustrated in FIG. 6D, the above-ground pool band-frame connector device 230B can be configured to removably couple the band 225 and the pool liner 220 to the above-ground pool vertical frame member 215 of the above-ground pool frame 205. In accordance with some embodiments of the present disclosure, once the above-ground pool band-frame connector device 230B is coupled to the band 225 it can increase the stability of the above-ground pool 200. Therefore, with some embodiments of the present disclosure, above-ground pool band-frame connector device 230 can be configured such that it can be removably inserted into the connector receiving aperture 310, which enables easy and convenient installation of the above-ground pool 200 and easy and convenient deconstruction of above-ground pool 200.

Figure 7:
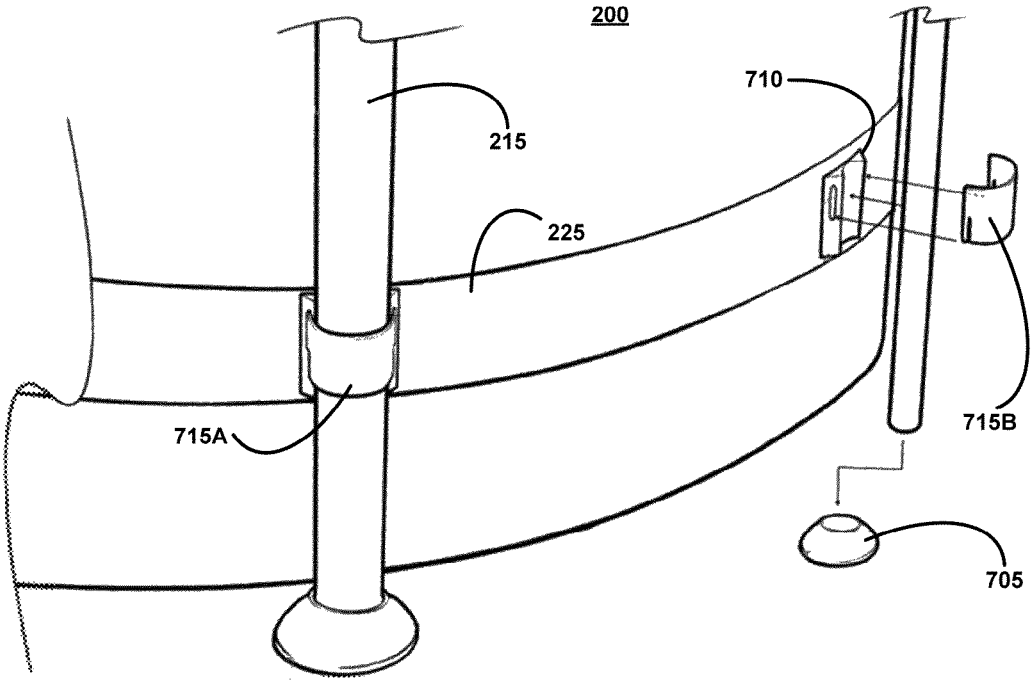
FIG. 7 is an illustration of a portion of the side of an above-ground pool 200 according to some embodiments of the present disclosure.

FIG. 7 is an illustration of a portion of the side of an above-ground pool 200 according to some embodiments of the present disclosure. As shown in the embodiment in FIG. 7, the above-ground pool 200 can include a plurality of cradles, such as cradle 710. The cradle 710, in accordance with some embodiments of the present disclosure, can be coupled to the band 225. Those of skill in the art will appreciate that there are a number of suitable ways to connect cradle 710 to the band 225. For example, cradle 710 can be welded to band 225, such as with an RF welding technique, heat welding, or adhesive techniques. Alternatively, cradle 710 can be coupled to band 225 with a friction fit in which two components of the cradle 710 are joined together with the band 225 in between, such that the cradle is 710 coupled via a friction fit with the band 225. As show in the embodiment in FIG. 7, a pole-band, such as pole-band 715B, can be removably coupled with cradle 710 such that the pole-band secures the above-ground pool vertical frame member 215 and restricts its movement. As shown in the embodiment in FIG. 7, the above-ground pool vertical frame member 215 can be inserted into a shoe, such as shoe 705, and then a pole-band, such a pole-band 715B, can be removably coupled to the cradle 710. In accordance with some embodiments of the present disclosure, the cradle 710 can provide two receiving slots into which a portion of the pole band 715B can be inserted. In accordance with some embodiments of the present disclosure, once the pole-band 715B is coupled to the cradle 710, thereby securing above-ground pool vertical frame member 215, it can increase the stability of the above-ground pool 200. Therefore, with some embodiments of the present disclosure, pole-band 715B can be configured such that it can be removably inserted into the cradle 710, which enables easy and convenient installation of the above-ground pool 200 and easy and convenient deconstruction of above-ground pool 200. As shown in the embodiment in FIG. 7, after installation, pole-band 715A can provide a stable and secure connection between the above-ground pool vertical frame member 215 of the above-ground pool frame 205 and the band 225 and pool liner 220 of the above-ground pool 200.

Figure 8:
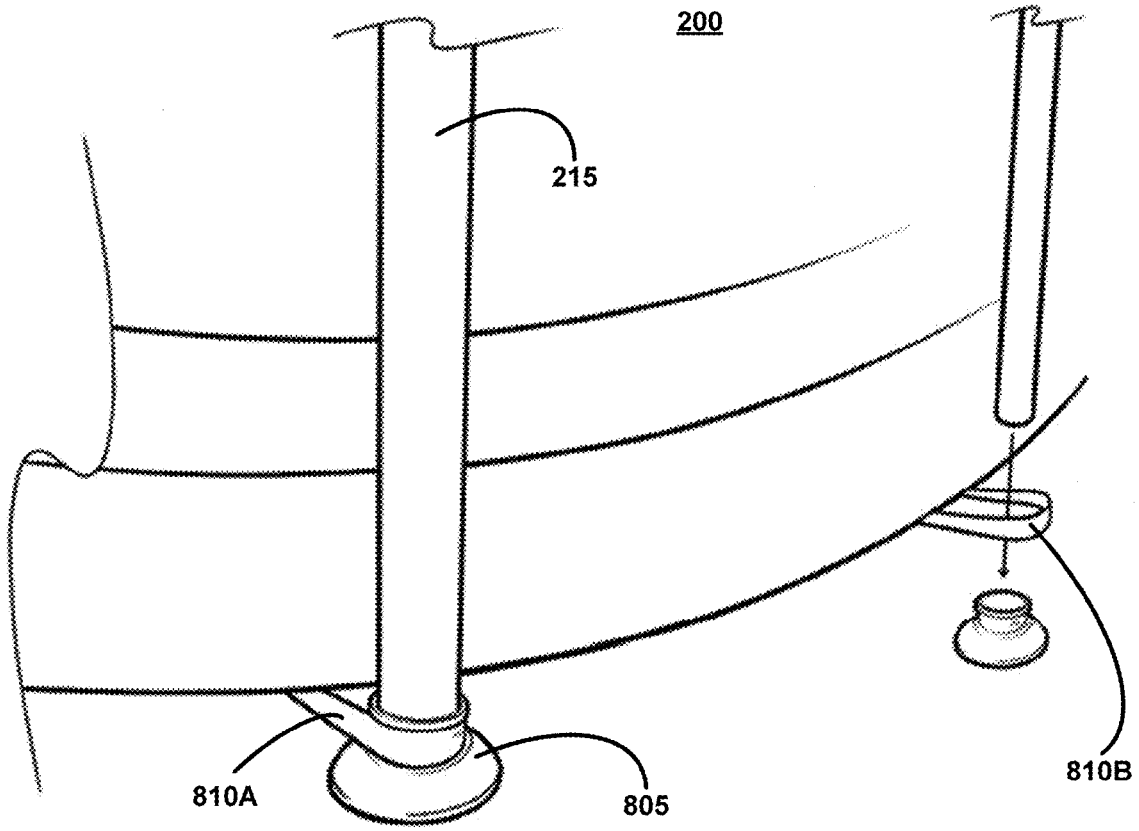
FIG. 8 is an illustration of a portion of the side of an above-ground pool 200 according to some embodiments of the present disclosure.

FIG. 8 is an illustration of a portion of the side of an above-ground pool 200 according to some embodiments of the present disclosure. As shown in the embodiment in FIG. 8, the above-ground pool 200 can include loop straps, such as loop straps 810A and 810B. The loop straps 810A and 810B, in accordance with some embodiments of the present disclosure, can be coupled to the bottom of the pool liner 220. Those of skill in the art will appreciate that there are a number of suitable ways to couple loop straps 810A and 810B to the pool liner 220. For example, loop straps 810A and 810B can be welded to pool liner 220, such as with an RF welding technique, heat welding, or adhesive techniques. Alternatively, loop straps 810A and 810B can be removably coupled with the pool liner 220 with a fastening mechanism. As show in the embodiment in FIG. 8, the loop straps can be removably coupled with to the above-ground pool vertical frame members 215. As show in the embodiment in FIG. 8, the above-ground pool vertical frame member 215 can be inserted into a shoe, such as shoe 805, and then a loop strap, such a loop strap 810A, can be removably coupled to the shoe 805. In accordance with some embodiments of the present disclosure, once the loop strap 810A is coupled to the shoe 805 holding above-ground pool vertical frame member 215, thereby securing above-ground pool vertical frame member 215, the loop strap 810A can increase the stability of the above-ground pool 200. Furthermore, in accordance with some embodiments of the present disclosure, once the loop strap 810A is coupled to the shoe 805 holding above-ground pool vertical frame member 215, the above-ground pool vertical frame member 215 can be pulled such that the pool liner 220 is pulled taunt thereby removing wrinkles from the pool liner 220. Therefore, with some embodiments of the present disclosure, loop strap 810A can be configured such that it can be removably coupled with the shoe 805 holding above-ground pool vertical frame member 215, which enables easy and convenient installation of the above-ground pool 200 and easy and convenient deconstruction of above-ground pool 200. In alternative embodiments, the loop strap 810A can be permanent affixed to shoe 805 for a convenient and easy construction with the above-ground pool vertical frame member 215. As shown in the embodiment in FIG. 8, after installation, loop strap 810A can provide a stable and secure connection between the above-ground pool vertical frame member 215 of the above-ground pool frame 205 and the pool liner 220 of the above-ground pool 200.

Figure 9:
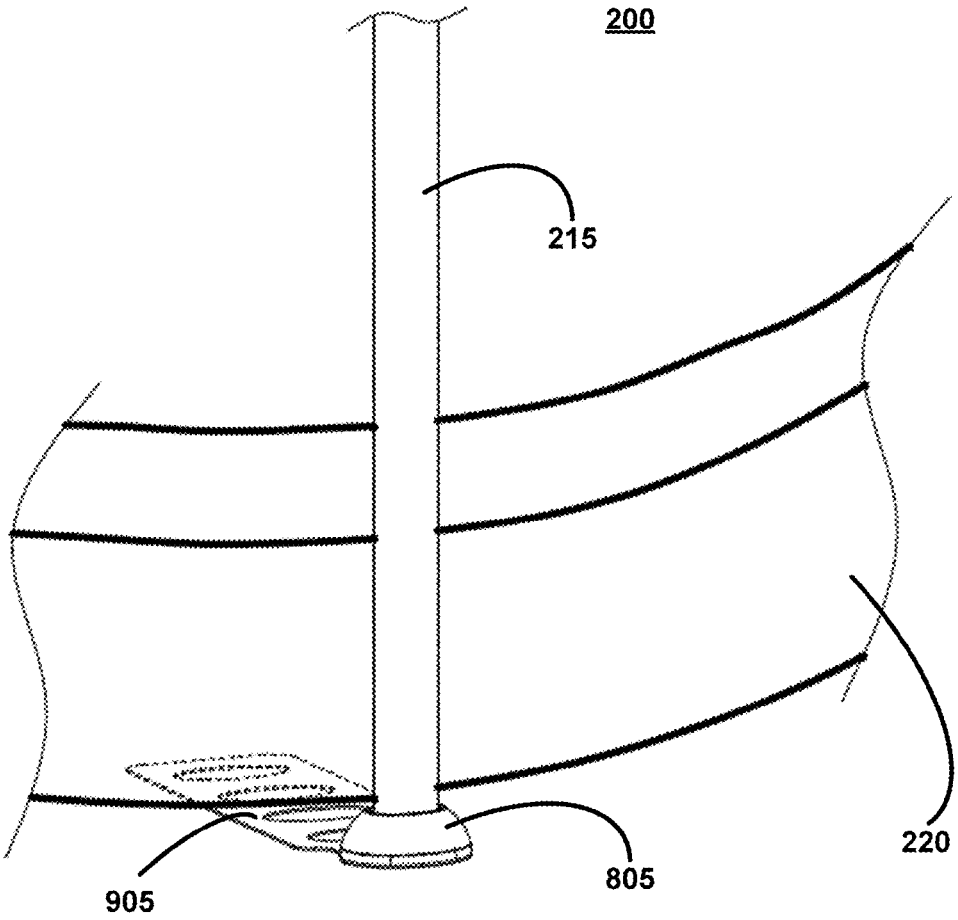
FIG. 9 is an illustration of a portion of the side of an above-ground pool 200 according to some embodiments of the present disclosure.

FIG. 9 is an illustration of a portion of the side of an above-ground pool 200 according to some embodiments of the present disclosure. As shown in the embodiment in FIG. 9, the above-ground pool vertical frame member 215 can be coupled to the bottom of the pool liner 220 with a pulling sheet 905. In accordance with some embodiments of the present disclosure, the pulling sheet 905 can be configured to couple with the shoe 805 into which the above-ground pool vertical frame member 215 is inserted. In accordance with some embodiments of the present disclosure, the shoe 805 into which the above-ground pool vertical frame member 215 is inserted can be coupled to a pulling sheet 905. As show in the embodiment illustrated in FIG. 9, the pulling sheet 905 can be configured to extend beneath the pool liner 220. In some embodiments, pulling sheet 905 can extend the full diameter of the above-ground pool 200 and pulling sheet 905 can connect two above-ground pool vertical frame members 215 on opposite sides of the above-ground pool 200. In these embodiments, the pulling sheet 905 can be configured beneath the pool liner and may not be attached to the pool liner. In accordance with some embodiments of the present disclosure, the user constructs the above-ground pool 200 by inserting the above-ground pool vertical frame member 215 into shoe 805, placing the pulling sheet 905 at least partially under the pool liner 220, and coupling the pulling sheet 905 to the shoe 805. In this embodiment, once the above-ground pool 200 is filled with water, the weight of the water can apply force to the pulling sheet 905. In other embodiments, the pulling sheet 905 does extend for the full diameter of the above-ground pool 200. In other embodiments of the present disclosure, the pulling sheet 905 is not physically attached to the pool liner 220, and just the weight of the water in the pool is used to restrict the movement of the pulling sheet 905. In other embodiments, the pulling sheet 905 can be coupled to the pool liner 220. Those of skill in the art will appreciate that numerous attachment techniques can be used to couple the pulling sheet 905 with the pool liner 220, including RF welding, heat welding, attachment with an adhesive, or physical attachment with a fastening mechanism. As shown in the embodiment illustrated in FIG. 9, the pulling sheet 905 can aid in resisting forces applied to above-ground pool vertical frame member 215 once the above-ground pool 200 is filled with water. As shown in the embodiment in FIG. 9, after installation, pulling sheet 905 can provide a stable and secure connection between the above-ground pool vertical frame member 215 of the above-ground pool frame 205 and the pool liner 220 of the above-ground pool 200.

Figure 10:
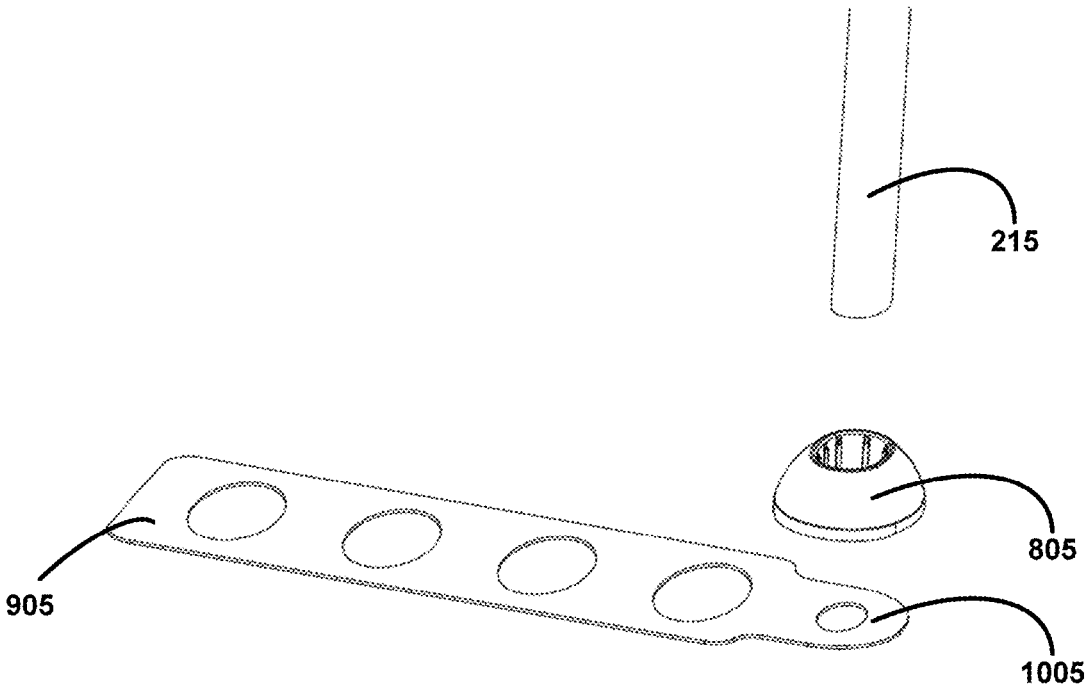
FIG. 10 is an illustration of a portion of the side of a pulling sheet 905 according to some embodiments of the present disclosure.

FIG. 10 is an illustration of a portion of the side of a pulling sheet 905 according to some embodiments of the present disclosure. As show in the embodiment in FIG. 10, one end of the pulling sheet 905 can provide a tab 1005 configured to be coupled with the shoe 805. In the embodiment shown in FIG. 10, tab 1005 provides an aperture into which a portion of the shoe 805 can be inserted and then coupled to remainder of the tab 1005. Furthermore, in the embodiment shown in FIG. 10, the above-ground pool vertical frame member 215 can be inserted into the shoe 805. Accordingly, in the embodiment show in FIG. 10, the above-ground pool vertical frame member 215, shoe 805, and pulling sheet 905 can be removably coupled together. Therefore, with some embodiments of the present disclosure, pulling sheet 905 can be configured such that it can be removably coupled with the shoe 805 holding above-ground pool vertical frame member 215, which enables easy and convenient installation of the above-ground pool 200 and easy and convenient deconstruction of above-ground pool 200.

Figure 11:
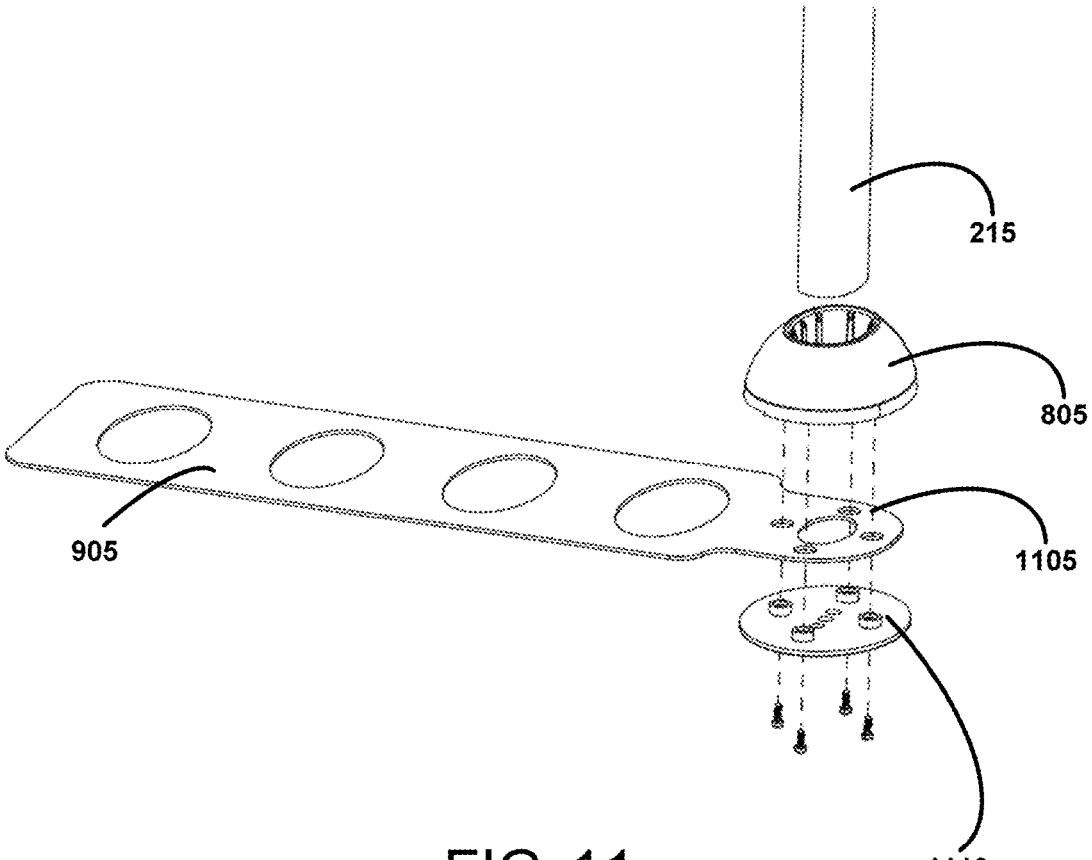
FIG. 11 is an illustration of portion of the side of a pulling sheet 905 according to some embodiments of the present disclosure.

FIG. 11 is an illustration of a portion of the side of a pulling sheet 905 according to some embodiments of the present disclosure. As show in the embodiment in FIG. 11, one end of the pulling sheet 905 can provide a tab 1105 configured to be coupled with the shoe 805. In the embodiment shown in FIG. 11, tab 1105 provides four apertures for receiving a bottom plate 1110. As shown in the embodiment shown in FIG. 11, the bottom plate can be coupled with the tab 1105 of the pulling sheet 905 and screws can be inserted to couple the bottom plate 1110, tab 1105 and the shoe 805 together. Furthermore, as shown in the embodiment shown in FIG. 11, the above-ground pool vertical frame member 215 can be inserted into the shoe 805. Accordingly, in the embodiment show in FIG. 11, the above-ground pool vertical frame member 215, shoe 805, bottom plate 1110, and pulling sheet 905 can be removably coupled together. Therefore, with some embodiments of the present disclosure, pulling sheet 905 can be configured such that it can be removably coupled with the shoe 805 holding above-ground pool vertical frame member 215, which enables easy and convenient installation of the above-ground pool 200 and easy and convenient deconstruction of above-ground pool 200.

The foregoing outlines features of several embodiments of the present disclosure so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An above-ground pool comprising:

a pool liner;

a band connected to the exterior of the pool liner;

a first connector receiving aperture between the band and the pool liner;

an above-ground pool frame comprising a plurality of above-ground pool horizontal frame members and a plurality of above-ground pool vertical frame members, wherein the above-ground pool frame can be coupled with the pool liner;

a first above-ground pool band-frame connector device;

wherein the first above-ground pool band-frame connector device couples a first of the plurality of above-ground pool vertical frame members to the band; and wherein the first above-ground pool band-frame connector device couples to the first of the plurality of above-ground pool vertical frame members to the band by inserting the connector protrusion into the first connector receiving aperture.

2. The above-ground pool of claim 1, wherein no substantial gaps are present between the band and the pool liner when the above-ground pool is filled with water.

3. The above-ground pool of claim 1, wherein none of the plurality of above-ground pool vertical frame members are in between the band and the pool liner when the above-ground pool is filled with water.

4. The above-ground pool of claim 1, wherein the first above-ground pool band-frame connector device further comprises a connector protrusion and a coupling ring, wherein the coupling ring is configured to couple to the first of the plurality of above-ground pool vertical frame members.

5. An above-ground pool band-frame connector device comprising:

a coupling ring, wherein the coupling ring is configured to be coupled to an above-ground pool vertical frame member of an above-ground pool frame of an above-ground pool;

a connector protrusion, wherein the connector protrusion can be inserted into a connector receiving aperture between a band and a pool liner of the above-ground pool; and wherein coupling the above-ground pool vertical frame member with the coupling ring and inserting the connector protrusion into the connector receiving aperture couples the above-ground pool vertical frame member with the band and the pool liner and increases the stability of the above-ground pool frame.

6. The above-ground pool band-frame connector device of claim 5, further comprising a flex slot.

7. The above-ground pool band-frame connector device of claim 6, wherein the flex slot extends for a portion of a length of the above-ground pool band-frame connector device along the long axis.

8. The above-ground pool band-frame connector device of claim 5, wherein the flex slot is configured to enable expansion and contraction of the coupling ring, enabling the coupling ring to expand to receive the above-ground pool vertical frame member.

* * * * *